US011771300B2

(12) United States Patent
Dunaway

(10) Patent No.: US 11,771,300 B2
(45) Date of Patent: Oct. 3, 2023

(54) UNIVERSAL BRACKET FOR SUPPORTING RACKS IN A DISHWASHER APPLIANCE

(71) Applicant: Haier US Appliance Solutions, Inc., Wilmington, DE (US)

(72) Inventor: Logan Chayse Dunaway, Greenville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/503,462

(22) Filed: Oct. 18, 2021

(65) Prior Publication Data

US 2023/0117541 A1 Apr. 20, 2023

(51) Int. Cl.
*A47L 15/50* (2006.01)

(52) U.S. Cl.
CPC ..... *A47L 15/507* (2013.01)

(58) Field of Classification Search
CPC .... A47L 15/4246; A47L 15/50; A47L 15/507; A47L 15/504; A47L 15/506; A47B 88/43; A47B 2210/0018; H05K 7/183
USPC ..... 211/41.1–41.9
See application file for complete search history.

(56) References Cited

U.S. PATENT DOCUMENTS 2,648,588 A * 8/1953 Ruspino ..... A47L 15/504 312/308
3,044,842 A * 7/1962 Abresch et al. .... B29C 33/0033 312/228.1
3,087,771 A * 4/1963 Pari ..... A47B 88/57 312/332
3,744,646 A * 7/1973 Duncan ..... A47L 15/507 211/151
3,834,784 A * 9/1974 Butsch ..... A47L 15/4246 312/351.3
4,147,393 A * 4/1979 Nelson ..... A47B 88/43 384/22
5,671,986 A * 9/1997 Vinet ..... A47L 15/507 312/334.21
5,683,159 A * 11/1997 Johnson ..... G06F 1/187 312/334.7
6,123,314 A * 9/2000 Steele ..... F16B 21/09 248/681
6,416,145 B1 7/2002 Singh
6,755,490 B2 * 6/2004 Welch ..... A47L 15/504 74/505
6,979,067 B2 * 12/2005 Yang ..... A47B 88/40 312/334.46

(Continued)

FOREIGN PATENT DOCUMENTS

DE 102013211560 A1 12/2014
EP 1323372 A2 * 7/2003 ..... A47L 15/507

*Primary Examiner* — Patrick D Hawn
(74) *Attorney, Agent, or Firm* — Dority & Manning, P.A.

(57) ABSTRACT

A dishwasher appliance includes two or more universal rack brackets. The universal rack brackets include a body, a stud on a first end of the body, and a snap fit securing element between the first and second ends of the body forming a protrusion from the body. A rail attachment element has two elongated slots that align with the studs of the universal rack brackets to slidably engage. The rail attachment element further includes a snap fit tab aligned such that sliding the rail attachment element to engage the studs of the universal rack brackets causes the snap fit tab to pass over the snap fit securing element and prevent return movement.

13 Claims, 8 Drawing Sheets

(56) References Cited

U.S. PATENT DOCUMENTS 7,455,066 B2 * 11/2008 Feddema ..... A47L 15/504 134/56 D
7,604,307 B2 * 10/2009 Greenwald ..... A47B 88/49 312/334.46
7,731,805 B2 * 6/2010 Banta ..... A47L 15/506 211/41.9
7,775,378 B2 * 8/2010 Tynes ..... A47L 15/504 211/41.8
7,794,031 B2 * 9/2010 Hsiung ..... A47B 88/57 312/334.46
8,366,217 B1 * 2/2013 Chen ..... H05K 7/1489 312/333
8,439,456 B2 * 5/2013 Kiechle ..... F16B 5/0233 411/546
8,528,994 B2 * 9/2013 Simmons ..... A47L 15/507 312/334.7
8,622,492 B2 * 1/2014 Chen ..... A47B 88/423 312/348.2
8,915,560 B2 * 12/2014 Cox ..... A47L 15/507 312/228
9,211,008 B2 7/2015 Chen et al.
9,581,182 B2 * 2/2017 Selle ..... F16B 12/26
10,004,381 B1 * 6/2018 Maddux ..... A47L 15/507
10,022,035 B2 * 7/2018 Dabade ..... A47L 15/507
10,034,597 B1 7/2018 Maddux et al.
10,201,230 B2 2/2019 Min
10,398,284 B2 * 9/2019 Hansen ..... A47L 15/507
10,456,006 B2 * 10/2019 Maddux ..... A47L 15/501
10,813,530 B2 * 10/2020 Maddux ..... A47L 15/507
2004/0075978 A1 * 4/2004 Chen ..... G06F 1/184 361/679.33
2006/0250058 A1 * 11/2006 Stevens ..... A47L 15/507 312/311
2013/0152983 A1 * 6/2013 Cox ..... A47L 15/507 134/164
2014/0145573 A1 * 5/2014 Cox ..... A47L 15/507 312/228.1
2015/0190034 A1 * 7/2015 Jeong ..... A47L 15/507 312/228.1
2020/0046199 A1 * 2/2020 Büsing ..... A47L 15/507
2022/0167827 A1 * 6/2022 Potluru ..... A47L 15/22
2022/0287544 A1 * 9/2022 Lee ..... A47L 15/507

* cited by examiner

UNIVERSAL BRACKET FOR SUPPORTING RACKS IN A DISHWASHER APPLIANCE

FIELD OF THE INVENTION

The present disclosure relates generally to dishwasher appliances, and more particularly to universal brackets for supporting the racks of dishwasher appliances.

BACKGROUND OF THE INVENTION

Dishwasher appliances generally include a tub that defines a wash chamber. Rack assemblies can be mounted within the wash chamber of the tub for receipt of articles for washing. Conventional dishwasher appliances include slide or roller assemblies for supporting one or more upper racks within the wash chamber and enabling movement of the racks in and out of the wash chamber. Various slide or roller assemblies may be used, and manufacturers typically offer different options for different dishwasher models. Notably, however, the different slide and roller assemblies are formed from many different parts and may be attached to the interior of the tub in different ways. As a result, the model of the dishwasher appliance must be known early in the production in the process, potentially causing longer lead times, complicating part procurement and storage, and raising costs. Furthermore, the differences between the various slide and roller assemblies may require different production processes, thereby increasing manufacturing complexity, further raising costs, and increasing the risk of assembly errors.

In other conventional designs, a bracket is employed between the tub and the slide rails or roller assemblies. These designs, however, generally require that the bracket be bolted to the typically stainless steel tub, requiring additional parts needed to seal the tub to prevent water leakage in addition to the hardware itself. Furthermore, such designs typically require the use of screws to connect the bracket to the slide and roller assemblies, thus increasing costs of hardware, procurement, storage, and labor for assembly.

Accordingly, a dishwasher appliance that utilizes a universal bracket without additional hardware for connecting the racks would be useful. More specifically, a bracket that is simple to assemble with slider or roller assemblies and may be universally used with different wash racks would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub and a universal rack bracket. The wash tub defines a wash chamber for receipt of articles for washing and includes an interior wall, at least a portion of the interior wall extending in the transverse direction. The universal rack bracket is attached to the interior wall of the wash tub and further includes a rack bracket body, a stud, and a snap fit securing element. The rack bracket body includes a first end and a second end spaced apart in the transverse direction and further having a front face and a back face spaced apart in the lateral direction. The stud is situated at the first end of the rack bracket body and extends laterally from the front face of the rack bracket body. The snap fit securing element is located between the first end and the second end of the rack bracket body and includes a lead in portion, an offset portion, and a tail portion. The offset portion is displaced from the rack bracket body in the lateral direction. The lead in portion connects the offset portion to the first end of the rack bracket body. The tail portion connects the offset portion to the second end of the rack bracket body. The lead in portion, the offset portion, and the tail portion of the snap fit securing element together form a protrusion extending laterally from the front face of the rack bracket body.

In accordance with another exemplary embodiment of the present disclosure a dishwasher appliance defining a vertical, a lateral, and a transverse direction is provided. The dishwasher appliance includes a wash tub, a first universal rack bracket, a second universal rack bracket, and a rail attachment element. The wash tub defines a wash chamber for receipt of articles for washing and includes an interior wall, at least a portion of the interior wall extending in the transverse direction. The first universal rack bracket and the second universal rack bracket are attached at the same height to the interior wall of the wash tub and further include a rack bracket body, a stud, and a snap fit securing element. The rack bracket body includes a first end and a second end spaced apart in the transverse direction and further having a front face and a back face spaced apart in the lateral direction. The stud is situated at the first end of the rack bracket body and extends laterally from the front face of the rack bracket body. The snap fit securing element is located between the first end and the second end of the rack bracket body and includes a lead in portion, an offset portion, and a tail portion. The offset portion is displaced from the rack bracket body in the lateral direction. The lead in portion connects the offset portion to the first end of the rack bracket body. The tail portion connects the offset portion to the second end of the rack bracket body. The lead in portion, the offset portion, and the tail portion of the snap fit securing element together form a protrusion extending laterally from the front face of the rack bracket body. The rail attachment element further includes a first elongated slot, a second elongated slot, and a snap fit tab. The first elongated slot is for slidably engaging at least a portion of the stud of the first universal rack bracket. The second elongated slot is for slidably engaging at least a portion of the stud of the second universal rack bracket. The snap fit tab is positioned between the first elongated slot and the second elongated slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
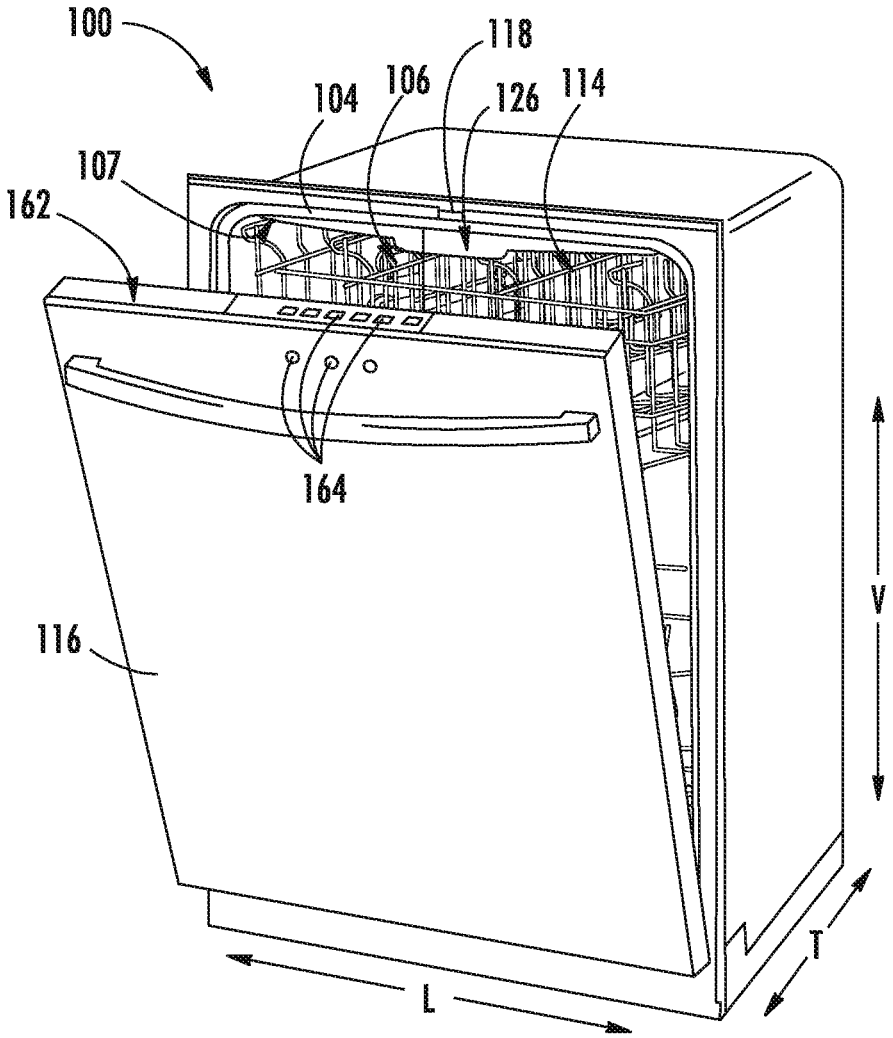
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
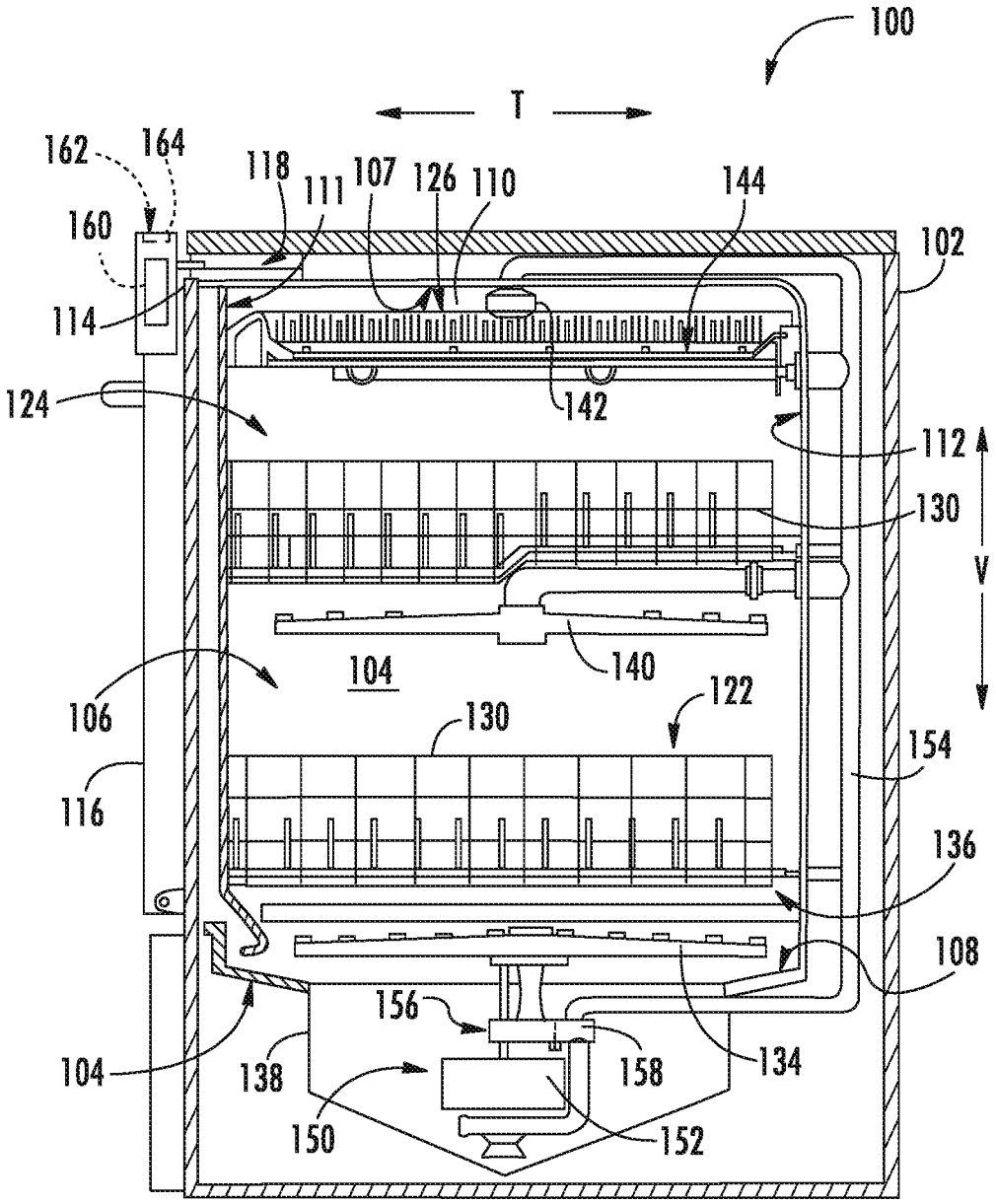
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of interior side walls 110 along a lateral direction L, and the interior side walls 110 extending between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
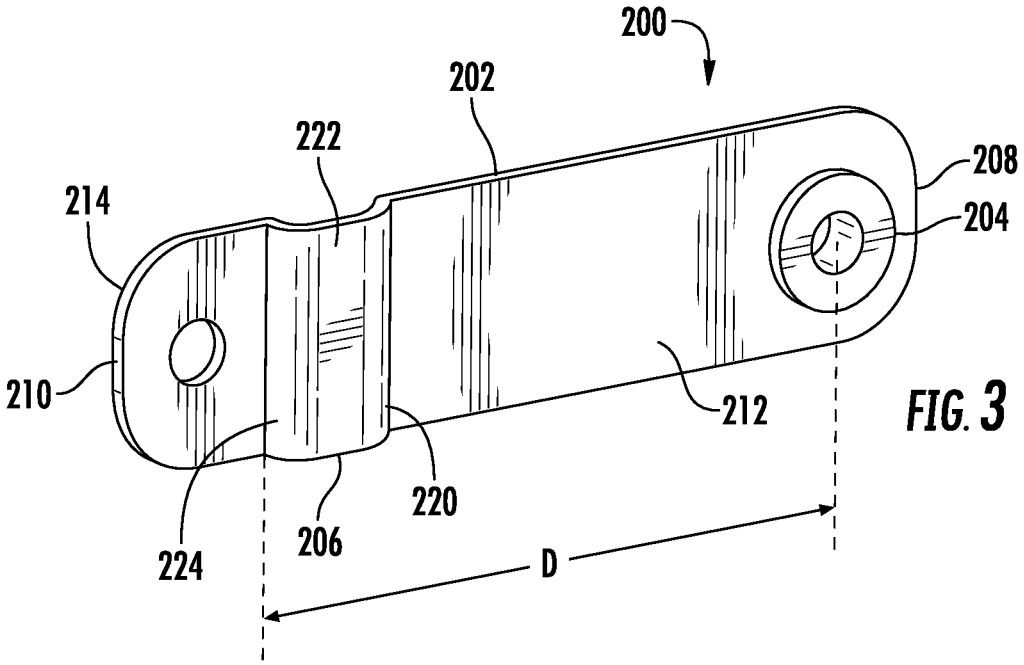
FIG. 3 provides a perspective view of a universal rack bracket according to an exemplary embodiment of the present disclosure.
Figure 5:
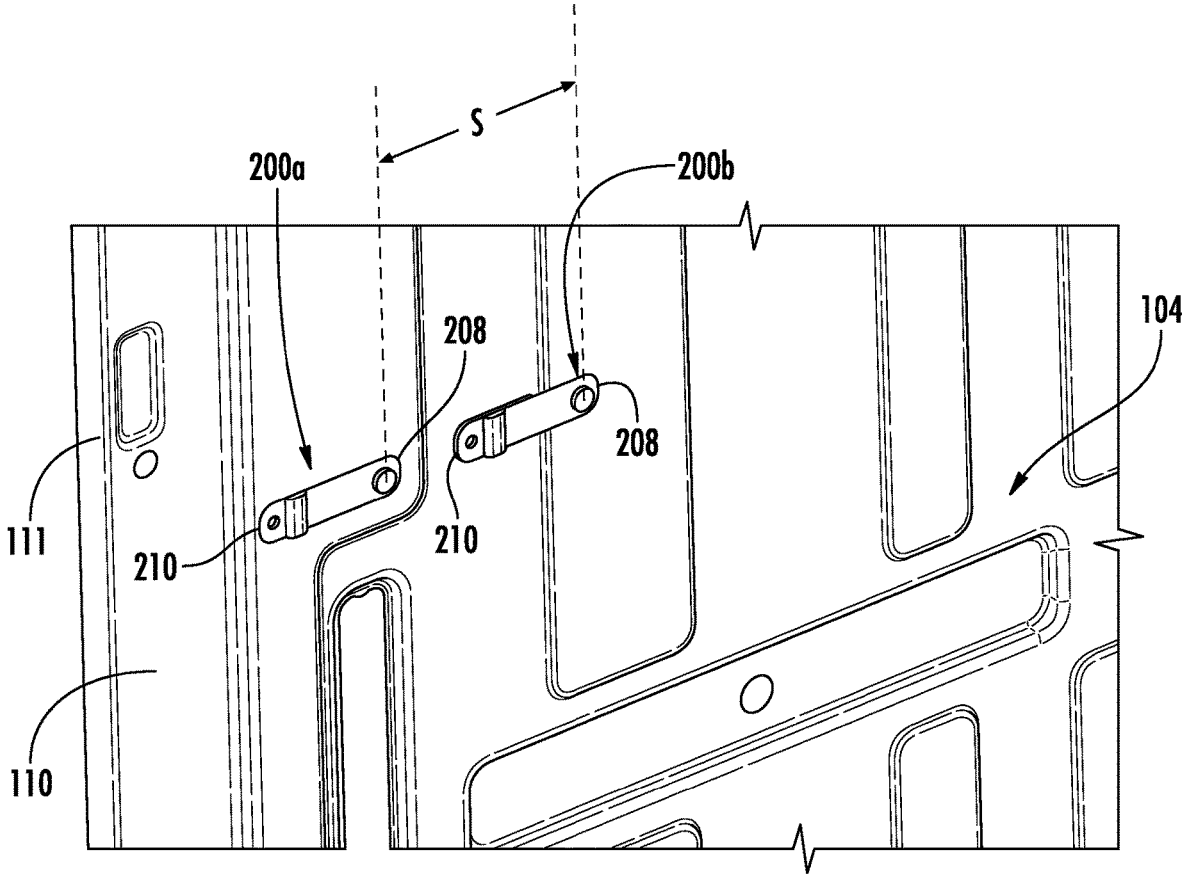
FIG. 5 provides a perspective view of a first universal rack bracket and a second universal rack bracket mounted to a sidewall of a dishwasher appliance according to an exemplary embodiment of the present disclosure.

FIG. 3 illustrates an exemplary universal rack bracket 200 in accordance with the present disclosure. Universal rack bracket 200 serves as a point of attachment for multiple racks having common geometries complementary to the universal rack bracket 200, as further described herein. Universal rack brackets 200 may be attached to the interior side wall 110 of the tub 104 (FIG. 5). In the preferred embodiment, universal rack brackets 200 are attached to tub 104 by means of a toxing process. The invention is not intended to be so limited, however. In alternative embodiments, other attachment techniques known in the art, such as spot-welding or riveting may be employed. While each of these techniques reduces part cost by eliminating penetration of the side wall 110, thus negating the need for components to seal the tub 104, attachment using penetrating techniques, such as by screws, nuts and bolts, and the like, are also acceptable alternatives.

Universal rack bracket 200 may include a rack bracket body 202, a stud 204, and a snap fit securing element 206. The rack bracket body 202 extends from a first end 208 to a second end 210. The first end 208 and the second end 210 of rack bracket body 202 are spaced apart from one another in the transverse direction when rack bracket body is mounted to tub 104, as further described below. In this orientation, rack bracket body 202 has a front face 212 facing the interior of tub 104 and a back face 214 facing side wall 110 such that front face 212 and rear face 214 are space apart from one another in the lateral direction.

As further shown in FIG. 3, stud 204 may be situated at the first end 208 of rack bracket body 202. In some embodiments, stud 204 may be a separate element from universal rack bracket 200 and may be attached to universal rack bracket via toxing, riveting, or other known methods. In alternative embodiments, stud 204 may be integral to universal rack bracket 200. As shown in FIG. 3, stud 204 may be generally circular in cross section. However, it need not be, and the shape of stud 204 is not critical to the present disclosure. For example, in alternative embodiments, the cross section of stud 204 may be square, rectangular, or any other shape consistent with the present disclosure.

Figure 4:
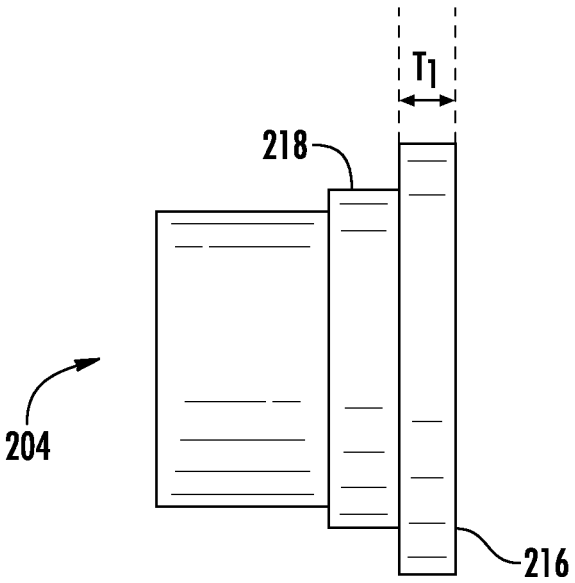
FIG. 4 provides a side view of a stud for a universal rack bracket according to an exemplary embodiment of the present disclosure.

Stud 204 extends laterally from the front face 212 of rack bracket body 202. Stud 204 may further include a stud head 216 and stud body 218, as illustrated in FIG. 4. Stud body 218 may be situated between stud head 216 and rack bracket body 202. Stud head 216 is generally wider that stud body 218. For example, in embodiments in which stud head 216 and stud body 218 are cylindrical, the radius of stud head 216 will be greater than the radius of stud body 218. In alternative embodiments in which stud head 216 and stud body 218 have different shapes, the width of stud head 216 in the vertical direction and transverse direction will be greater than the corresponding width of stud body 218. While typically the difference in width will be uniform around the entirety of stud head 216 and stud body 218, it need not be. For example, it is within the scope of the invention that the stud head 216 have a greater width than stud body 218, but that the difference in width be offset only on the side of stud body 218 nearest to the first end 208 of rack bracket body 202, for reasons described herein.

Referring again to FIG. 3, universal rack bracket 200 may further include a snap fit securing element 206 situated between first 208 and second end 210 of rack bracket body 202. Snap fit securing element 206 may include a lead in portion 220, an offset portion 222, and a tail portion 224. Offset portion 222 of snap fit securing element 206 is generally offset or displaced from rack bracket body 202 in the lateral direction and extending from the front face 212 of rack bracket body 202 toward the interior of tub 104. As illustrated in the embodiment of FIG. 3, offset portion 222 may be planar and substantially parallel to rack bracket body 202. That is, it may extend in the lateral direction. However, offset portion 222 need not be precisely parallel rack bracket body 202 nor is it required that offset portion 222 is planar to fall within the scope of the present disclosure. In some embodiments, offset portion may be substantially parallel within 5 degrees. In other embodiments, offset portion may not be planar at all, but rather may be the peak of a triangle formed by lead in portion 220 and tail portion 224. The geometry of offset portion 222 merely serves as a maximum offset location to prevent transverse movement of other elements and, in some embodiments, to provide support, as further described herein.

Lead in portion 220 of snap fit securing element 206 connects to offset portion 222 on one end and to first end 208 of rack bracket body 202 on the other end. In the preferred embodiment, lead in portion 220 is tapered to allow other elements to slide onto and over its surface without significant impediment, as illustrated in FIG. 3 and described herein. As used herein, tapered is intended to include not only inclined, flat surface, but rounded surfaces as well, so long as the angle is small enough to permit the elements to slide from first end 208 of rack bracket body 202 to offset portion 222 without significant impediment (i.e., without preventing sliding).

Tail portion 224 of snap fit securing element 206 connects to offset portion 222 on one end and to second end 210 of rack bracket body 202 on the other end. Tail portion 224 may be shaped so as to prevent elements from sliding from the direction of second end 210 to offset portion 222. For example, tail portion 224 may form a 90-degree angle with second end 210 of rack bracket body 206, although this precise geometry is not necessary to fall within the scope of the present disclosure. It will be readily apparent to those skill in the art that any angle between tail portion 224 and second end 210 which prevents back sliding, as further described herein, would suffice.

Lead in portion 220, offset portion 222, and tail portion 224 may be distinct elements in some embodiments. However, it is contemplated that, in other embodiments, lead in portion 220, offset portion 222, and tail portion 224 may only be conceptual elements formed as a single component. The combination of lead in portion 220, offset portion 222, and tail portion 224 together form a protrusion extending laterally from front face 212 of rack bracket body 202, as illustrated in FIG. 3.

In the preferred embodiment, a first universal rack bracket 200*a* and a second universal rack bracket 200*b* are attached to each interior side wall 110. First universal rack bracket 200*a* and second universal rack bracket 200*b* are generally aligned on the same horizontal plane (i.e., at the same height). They are further oriented in the same way as each (i.e., first ends 208 of both first universal rack bracket 200*a* and second universal rack bracket 200*b* are further from the front side 111 of dishwasher appliance 100 than second ends 210), as illustrated in FIG. 5. First universal rack bracket 200*a* and second universal rack bracket 200*b* are further spaced apart from one another in the transverse direction such that the distance between the center of stud 204 of first universal rack bracket 200*a* and the center of stud 204 of second universal rack bracket 200*b* is a distance S.

Dishwasher appliance 100 may further include a rail attachment element 230, as illustrated in FIGS. 6-9. Rail attachment element 230 may further include a first elongated slot 232, a second elongated slot 234, and a snap fit tab 236. First elongated slot 232 engages at least a portion of stud 204 of first universal bracket 200*a*. Second elongated slot 234 engages at least a portion of stud 204 of second universal bracket 200*b*. In the embodiments of FIGS. 6-9, both first elongated slot 232 and second elongated slot 234 have a wide end 238 and a narrow end 240. Wide end 238 and narrow end 240 may be generally circular in shape, with wide end 238 having a larger diameter than narrow end 240 such that first elongated slot 232 and second elongated slot 234 are tapered. In alternative embodiments, wide end 238 and narrow end 240 may have different shapes, such as, for example, square or rectangular, that correspond to the shape of stud 204. It is contemplated that, in some embodiments, first elongated slot 232 may have a different shape than second elongated slot 234. First elongated slot 232 is spaced apart of second elongated slot 234 by a distance S, the same distance that separate studs 204 of first universal bracket 200*a* and second universal bracket 200*b*.

Rail attachment element 230 may be attached to first universal rack bracket 200*a* and second universal rack bracket 200*b* by passing stud head 216 of first universal bracket 200*a* through wide end 238 of first elongated slot 232 and passing stud head 216 of second universal bracket 200*b* through wide end 238 of second elongated slot 234 in the lateral direction. As will be apparent, the width of wide end 238 (or diameter, if circular) exceeds the width (or diameter) of stud head 216, permitting passage of stud head 216. By sliding rail attachment element 230 in the transverse direction, stud 204 passes from the wide ends 238 to the narrow ends 240 of first elongated slot 232 and second elongated slot 234 until its motion is obstructed by stud body 218, preventing further transverse movement in that direction. The width of narrow end 240 (or diameter, if circular) is exceeded by the width (or diameter) of stud head 216, thereby preventing lateral movement of rail attachment element 230 relative to stud 204, first universal rack bracket 200*a* and second universal rack bracket 200*b*.

Figure 7:
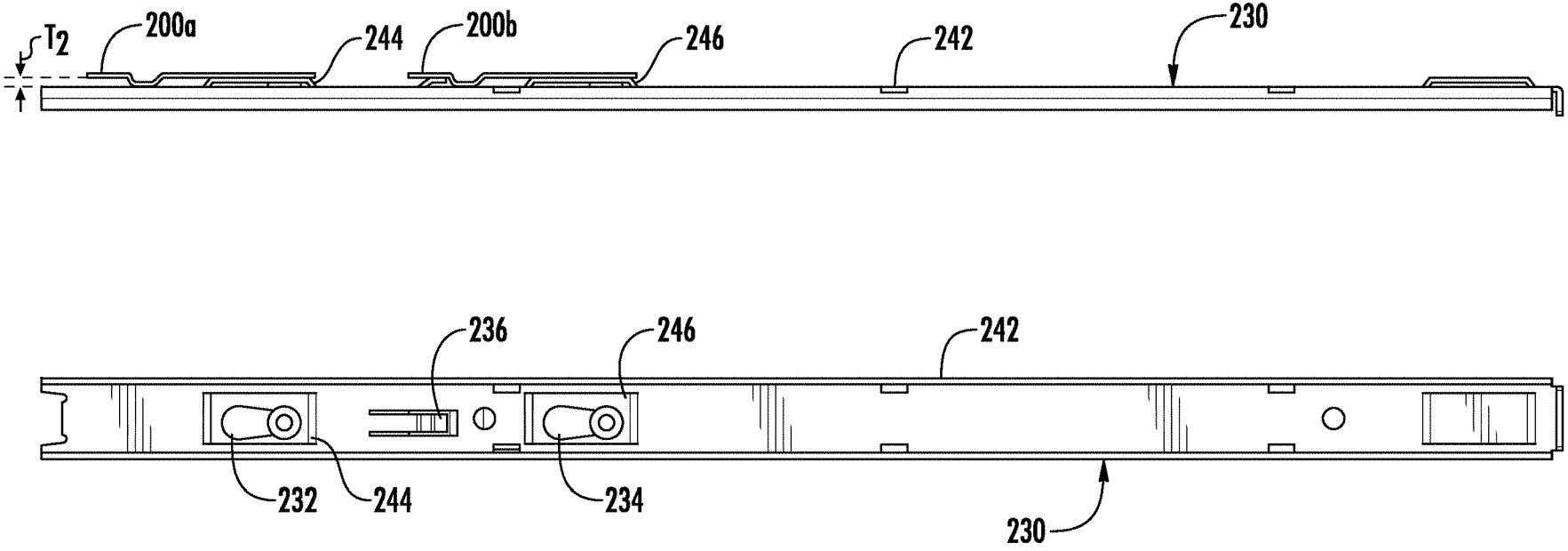
FIG. 7 provides a top and side view of an exemplary rail attachment element mounted to exemplary first and second universal rack brackets according to an exemplary embodiment of the present disclosure.
Figure 9:
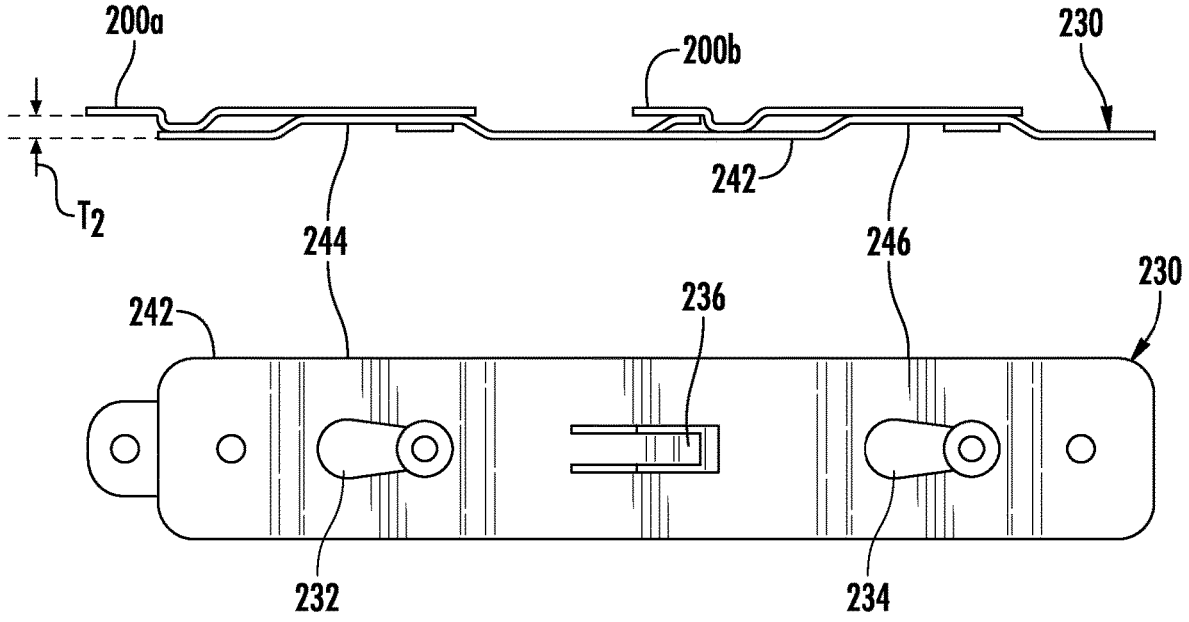
FIG. 9 provides a top and side view of an exemplary rail attachment element mounted to exemplary first and second universal rack brackets according to an exemplary embodiment of the present disclosure.

As shown in FIGS. 7 and 9, rail attachment element 230 may further include a rail attachment body 242, a first recessed portion 244, and a second recessed portion 246. First elongated slot 232 is located on first recessed portion 244 and second elongated slot 234 is located on second recessed portion 246. First recessed portion 244 and second recessed portion 246 are recesses in the lateral direction toward side wall 110 having the same lateral depth (i.e., the later distance between rail attachment body 242 and first recessed portion 244 is substantially the same as the lateral distance between rail attachment body 242 and second recessed portion 246). Further, in some embodiments, this distance is also the same as the lateral distance between rack bracket body 202 and offset portion 222 of snap fit securing element 206. As one of ordinary skill will recognize, by having this common dimension, offset portion 222 of snap fit securing element 206 is in contact rail attachment body 242 when universal rack bracket 200 is attached to rail attachment element 230, thereby providing additional stability to rail attachment element 230.

It should also be noted that the lateral thickness of first recessed portion 244 and the second recessed portion 246 is less than the lateral length of stud body 218, thus permitting first recessed portion 244 and the second recessed portion 246 to slide between stud head 216 and rack bracket body 202 when studs 204 are situated at narrow ends 240 of first elongated slot 232 and second elongated slot 234. In some embodiments, the lateral thickness of wide ends 238 of first elongated slot 232 and second elongated slot 234 may be less than the lateral thickness of narrow ends 240 of first elongated slot 232 and second elongated slot 234, with narrow ends 240 having a lateral thickness substantially equal to the lateral length of stud body 218. In such embodiments, sliding stud 204 from wide end 238 to narrow end 240 can result in a compression fit between stud head 216 and rack bracket body 202, aiding in resistance to transverse and lateral movement of rail attachment element 230 relative to first universal rack bracket 200*a* and second universal rack bracket 200*b*.

It should be recognized that rail attachment element 230 may, in certain embodiments, define a channel (not pictured) in which rack assemblies 122, 124, or 126 may roll or slide. This motion could be inhibited if any element of universal rack bracket 200, including stud 204, occupies the volume within the channel. Accordingly, in one embodiment, stud head 216 may have a lateral width $t_1$ (FIG. 4). Additionally, the lateral distance between the face of rail attachment body 242 and the opposing face of first recessed portion 244 (as well as second recessed portion 246) may be a distance $t_2$ (FIGS. 7 and 9). Further, the lateral width of stud head 216, $t_1$, is less than the lateral distance between the face of rail attachment body 242 and the opposing faces of both first recessed portion 244 and second recessed portion 246, $t_2$. In this manner, stud head 216 remains within the volume defined by first recessed portion 244 and second recessed portion 246, preventing interference with movement along the channel.

As previously noted, rail attachment element 230 also includes snap fit tab 236. Snap fit tab 236 is connected on one end to rail attachment element 230 and free on its other end. As a result, snap fit tab 236 may pivot in the lateral direction from an unflexed position, substantially aligned with rail attachment element 230, to an extended position (not pictured) at an angle to rail attachment element 230. Snap fit tab 236 is biased to the unflexed position.

Figure 6:
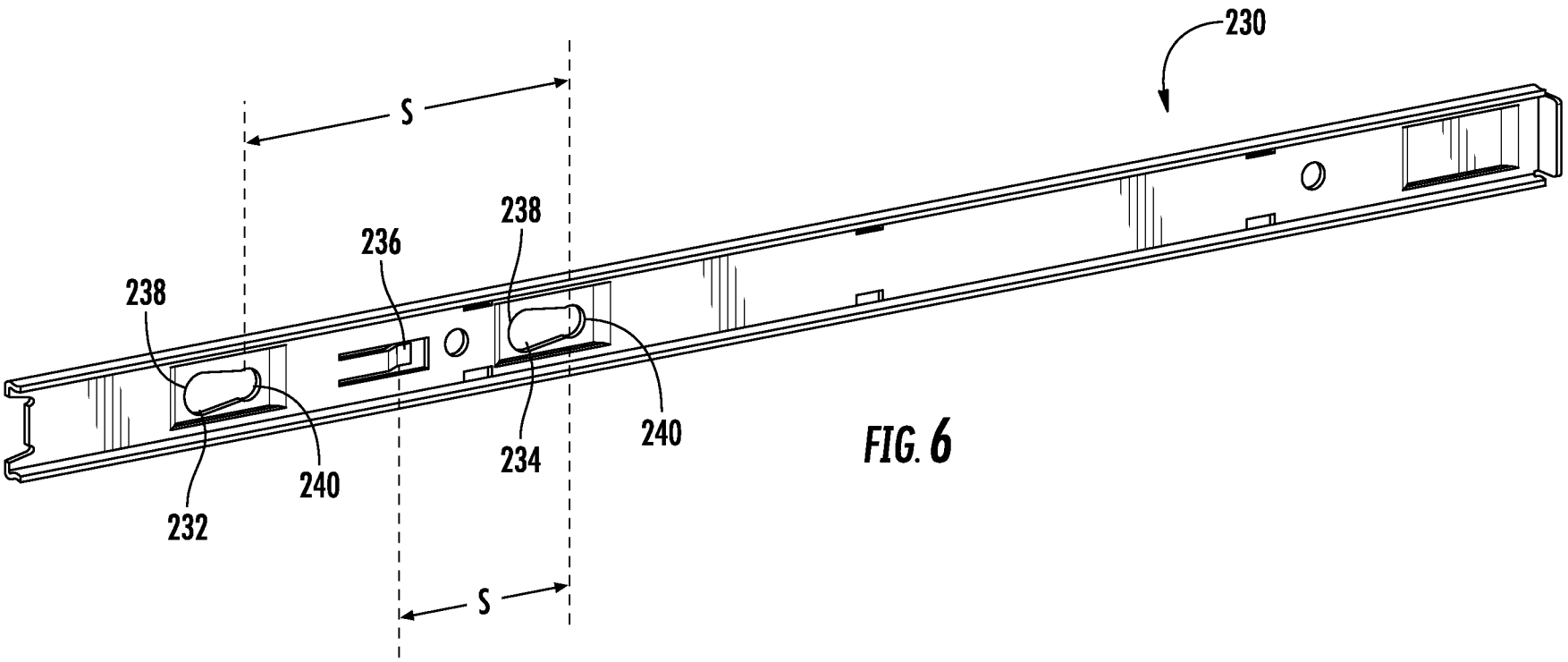
FIG. 6 provides a perspective view of an exemplary rail attachment element according to an exemplary embodiment of the present disclosure.
Figure 8:
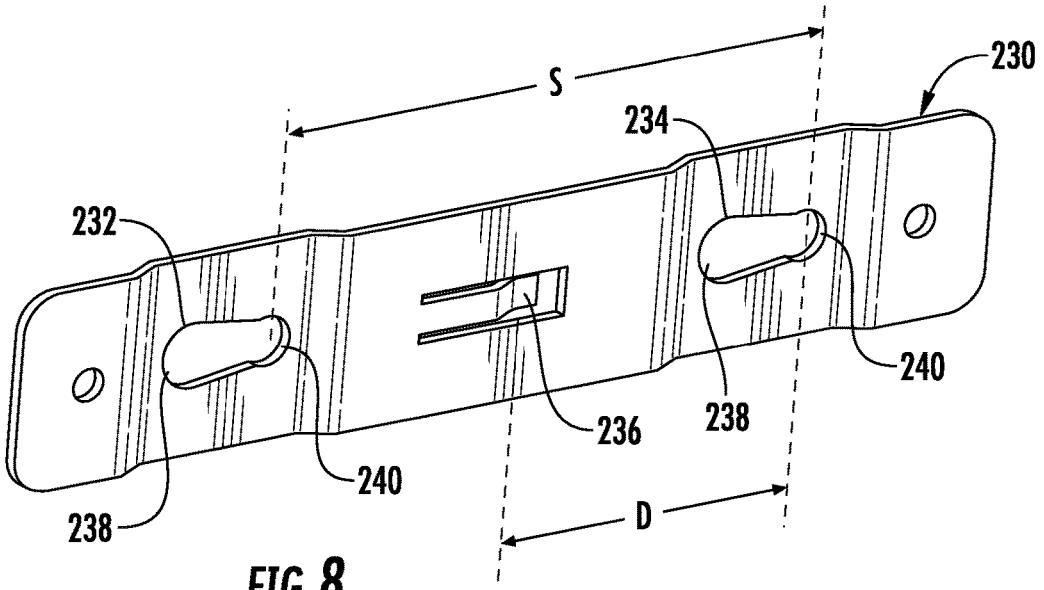
FIG. 8 provides a perspective view of an exemplary rail attachment element according to an exemplary embodiment of the present disclosure.

Snap fit tab 236 is positioned between first elongated slot 232 and second elongated slot 234. In particular, snap fit tab 236 is located a transverse distance D from the center of narrow end 240 of second elongated slot 234 (FIGS. 6, 8). Likewise, for universal rack bracket 200, there is a lateral distance D between the center of stud 204 and the point at which tail portion 224 of snap fit securing element 206 meets second end 210 of rack bracket body 202 (FIG. 3). As a result of this common dimension, when studs 204 of first universal rack bracket 200*a* and second universal rack bracket 200*b* are inserted into wide ends 238 of first elongated slot 232 and second elongated slot 234, snap fit tab 236 is in the unflexed position beside first end 208 of rack bracket body 208 of second universal rack bracket 200*b*. As rack attachment element 230 slides such that studs 204 transition into narrow ends 240 of first elongated slot 232 and second elongated slot 234, snap fit tab 236 passes over lead in portion 220 of snap fit securing element 206 of second universal rack bracket 200*b*, transitioning snap fit tab 236 to the extended position, allowing snap fit securing element 236 to pass over offset portion 222 and tail portion 224 of snap fit securing element 206. As snap fit tab 236 passes tail portion 224 of snap fit securing element 206, it transitions back to the unflexed position. As previously noted, in certain embodiments, tail portion 224 of snap fit securing element 206 is shaped so as to prevent backsliding of snap fit tab 236 in the direction of offset portion 222 of snap fit securing element 206, thus preventing transverse movement of rail attachment element 230 relative to universal rack brackets 200 in that direction.

As can be seen in FIGS. 6-9, first universal rack bracket 200*a* and second universal rack bracket 200*b* are considered universal, as used herein, because they are capable of attaching to a variety of different rail attachment elements 230 having a common geometry. For example, in FIGS. 6-7, rail attachment element 230 is a ball bearing slide rail. Additionally, in FIGS. 8-9, rail attachment element 230 is a wheels on rails bracket.

Figure 10:
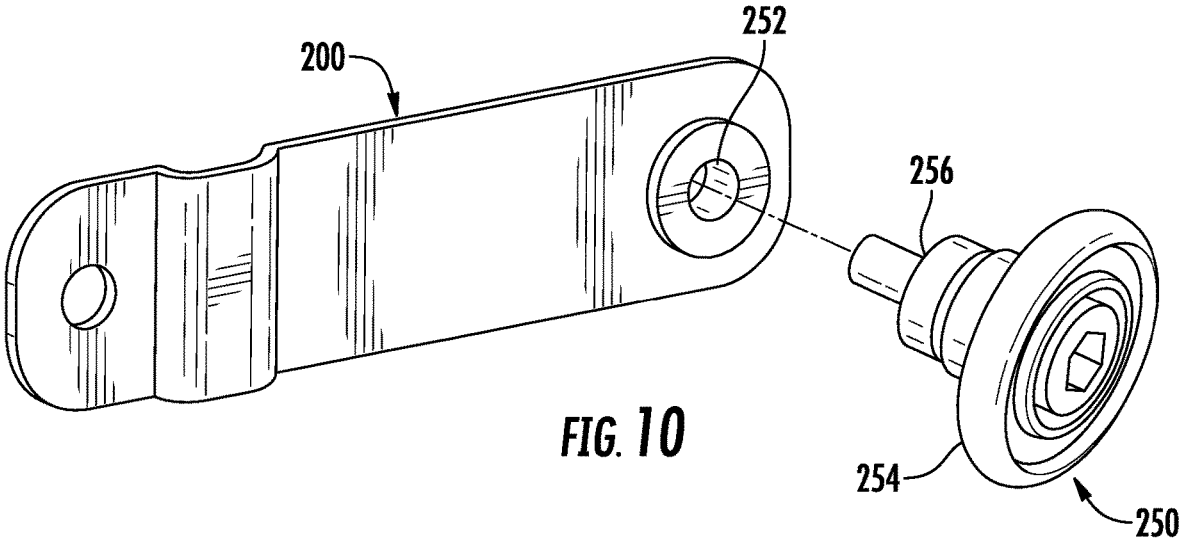
FIG. 10 provides a perspective exploded view of an exemplary universal rack bracket and roller assembly according to an exemplary embodiment of the present disclosure.

Alternatively, or additionally, universal rack bracket 200 may not be attached to rail attachment element 230, but rather may attach directly to roller assembly 250, as illustrated in FIG. 10. In such embodiments, universal rack bracket 200 of dishwasher appliance 100 may further include a through hole 252. Through hole 252 may extend through stud head 216, stud body 218, and rack bracket body 202. Roller assembly 250 may further include a wheel 254 and a wheel stud 256. Wheel stud 256 may be inserted into through hole 252 and attached to universal rack bracket 200 using conventional means known in the art.

Figure 11:
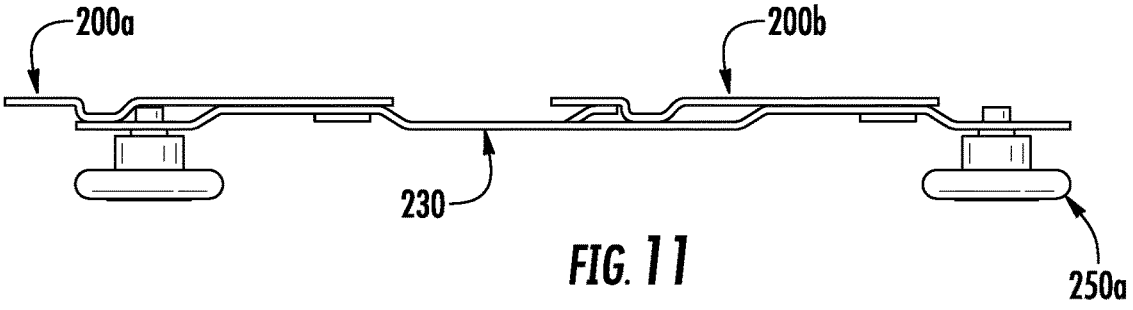
FIG. 11 provides a top view of exemplary first and second universal rack brackets, rail attachment element, and roller assembly according to an exemplary embodiment of the present disclosure.

In still other embodiments, as illustrated in FIG. 11, roller assembly 250*a* may be used in combination with first universal rack bracket 200*a*, second universal rack bracket 200*b*, and rail attachment element 230. In such embodiments wheel stud 256 of roller assembly 250*a* could be inserted into through holes on rail attachment element 230 (see FIGS. 8 and 9) and attached in any conventional manner.

Although certain embodiments of the present disclosure are explained in the context of a dishwasher appliance 100 having a first universal rack bracket 200*a* and a second universal rack bracket 200*b*, this is for illustrative purposes only. One of ordinary skill in the art will recognize that any reasonable number uniform rack brackets could be employed with corresponding elongated slots aligned on the rail attachment element.

One of ordinary skill in the art will further recognize that alternative orientations of universal rack bracket 200 and rail attachment element 230 will fall within the scope of the present disclosure. Although certain embodiments of the present disclosure describe first end 208 and second end 210 of universal rack bracket 200 as being spaced apart in the transverse direction, alternative embodiments in which first end 208 and second end 210 are spaced apart in the vertical direction are also intended to fall within the scope of the present disclosure. In such embodiments, rail attachment element 230 may attach to universal rack bracket 200 in the same way as described in other embodiments described herein, with the exception that the previously described movement (or prevention of movement) of rail attachment element 230 relative to universal rack bracket 200, and their composite elements, in the transverse direction would instead be understood by the skilled artisan as movement (or prevention of movement) in the vertical direction. For example, and more specifically, wide ends 238 of rail attachment element 230 would still fit over studs 204 of universal rack brackets 200*a*, 200*b*, but rail attachment element 230 would slide vertically to transfer studs 204 from wide ends 238 to narrow ends 240 of rail attachment element 230. Another variation in these embodiments, may include the vertical orientation and direction of movement of snap fit tab 236 relative to snap fit securing element 206. These and other variations would be apparent to one of ordinary skill in the art as a result of a vertical orientation of universal rack bracket 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber for receipt of articles for washing, the wash tub including an interior wall, at least a portion of the interior wall extending in the transverse direction;

a first rack bracket and a second rack bracket attached to the interior wall of the wash tub at the same height, each of the first rack bracket and second rack bracket further comprising a rack bracket body having a first end and a second end and further having a front face and a back face spaced apart in the lateral direction;

a stud at the first end of the rack bracket body, the stud extending laterally from the front face of the rack bracket body, wherein the stud further comprises a stud head and a stud body, the stud body located between the stud head and the rack bracket body and wherein the stud head is wider than the stud body;

a snap fit securing element located between the first end and the second end of the rack bracket body and having a lead in portion, an offset portion, and a tail portion, the offset portion being displaced from the rack bracket body in the lateral direction, the lead in portion connecting the offset portion to the first end of the rack bracket body, and the tail portion connecting the offset portion to the second end of the rack bracket body, and wherein the lead in portion, the offset portion, and the tail portion of the snap fit securing element together form a protrusion extending laterally from the front face of the rack bracket body; and a rail attachment element comprising a first elongated slot for slidably engaging at least a portion of the stud of the first rack bracket;

a second elongated slot for slidably engaging at least a portion of the stud of the second rack bracket, wherein the first elongated slot and the second elongated slot of the rail attachment element further comprise a wide end and a narrow end and the wide end is sized such that the stud head of the first and second rack bracket may pass through the rail attachment bracket in the lateral direction and the narrow end is sized such that the stud head of the first and second rack bracket may not pass through the rail attachment bracket in the lateral direction;

a snap fit tab positioned between the first elongated slot and the second elongated slot, wherein the snap fit tab is further positioned such that the snap fit tab passes over the snap fit securing element of the second rack bracket as first elongated slot slideably engages at least a portion of the stud of the first rack bracket and the second elongated slot slideably engages at least a portion of the stud of the second rack bracket, wherein the snap fit tab of the rail attachment element is positioned such that the snap fit tab passes over the snap fit securing element of the second rack bracket as the stud of the first rack bracket passes from the wide end of first elongated slot of the rail attachment element to the narrow end of the first elongated slot of the rail attachment.

2. The dishwasher appliance of claim 1, wherein the lead in portion of the snap fit securing element is tapered such that the snap fit tab may slide in the transverse direction toward the offset portion of the snap fit securing element.

3. The dishwasher appliance of claim 2, wherein the tail portion of the snap fit securing element is shaped so as to prevent transverse movement of the snap fit tab in the direction of the offset portion of the snap fit securing element.

4. The dishwasher appliance of claim 1, wherein the rail attachment element further comprises a rail attachment body, a first recessed portion, and a second recessed portion.

5. The dishwasher appliance of claim 4, wherein the first elongated slot is located on the first recessed portion and the second elongated slot is located on the second recessed portion.

6. The dishwasher appliance of claim 5, wherein the lateral distance between the rail attachment body and the first recessed portion is substantially the same as the lateral distance between the rail attachment body and the second recessed portion and the lateral distance between the rack bracket body and the offset portion of the snap fit securing element.

7. The dishwasher appliance of claim 6, wherein the lateral width of the stud head is less than the lateral distance between the rail attachment body and the first recessed portion such that the stud head does not extend beyond the rail attachment body in the lateral direction.

8. The dishwasher appliance of claim 3, wherein the offset portions of the snap fit securing elements of the first and second rack brackets are in contact with the rail attachment element when the rail attachment element is connected to the first and second rack brackets.

9. The dishwasher appliance of claim 1, wherein the rail attachment element is a ball bearing slide rail.

10. The dishwasher appliance of claim 1, wherein the rail attachment element is a wheels on rails bracket.

11. A dishwasher appliance defining a vertical, a lateral, and a transverse direction, the dishwasher appliance comprising:

a wash tub that defines a wash chamber for receipt of articles for washing, the wash tub including an interior wall, at least a portion of the interior wall extending in the transverse direction;

a first rack bracket and a second rack bracket attached to the interior wall of the wash tub at the same height, each of the first rack bracket and second rack bracket further comprising a rack bracket body having a first end and a second end and further having a front face and a back face spaced apart in the lateral direction;

a stud at the first end of the rack bracket body, the stud extending laterally from the front face of the rack bracket body, wherein the stud further comprises a stud head and a stud body, the stud body located between the stud head and the rack bracket body and wherein the stud head is wider than the stud body;

a snap fit securing element located between the first end and the second end of the rack bracket body and having a lead in portion, an offset portion, and a tail portion, the offset portion being displaced from the rack bracket body in the lateral direction, the lead in portion connecting the offset portion to the first end of the rack bracket body, and the tail portion connecting the offset portion to the second end of the rack bracket body, and wherein the lead in portion, the offset portion, and the tail portion of the snap fit securing element together form a protrusion extending laterally from the front face of the rack bracket body; and a rail attachment element, wherein the rail attachment element is connectable to the first and second rack bracket body such that the first and second rack brackets are in contact with the rail attachment element when the rail attachment element is connected to the first and second rack brackets, the rail attachment element comprising a first elongated slot for slidably engaging at least a portion of the stud of the first rack bracket;

a second elongated slot for slidably engaging at least a portion of the stud of the second rack bracket, wherein the first elongated slot and the second elongated slot of the rail attachment element further comprise a wide end and a narrow end, wherein the wide end is sized such that the stud head of the first and second rack bracket may pass through the rail attachment bracket in the lateral direction and the narrow end is sized such that the stud head of the first and second rack bracket may not pass through the rail attachment bracket in the lateral direction;

a snap fit tab positioned between the first elongated slot and the second elongated slot, wherein the snap fit tab of the rail attachment element is positioned such that the snap fit tab passes over the snap fit securing element of the second rack bracket as the stud of the first rack bracket passes from the wide end of first elongated slot of the rail attachment element to the narrow end of the first elongated slot of the rail attachment.

12. The dishwasher appliance of claim 11, wherein the lead in portion of the snap fit securing element is tapered such that the snap fit tab may slide in the transverse direction toward the offset portion of the snap fit securing element.

13. The dishwasher appliance of claim 12, wherein the tail portion of the snap fit securing element is shaped so as to prevent transverse movement of the snap fit tab in the direction of the offset portion of the snap fit securing element.

* * * * *